United States Patent [19]

Blach

[11] 4,114,204

[45] Sep. 19, 1978

[54] WATER-FLOW CONTROL DEVICE AND METHOD

[76] Inventor: James P. Blach, 1563 Begen Ave., Mountain View, Calif. 94040

[21] Appl. No.: 813,758

[22] Filed: Jul. 7, 1977

[51] Int. Cl.[2] ..... E03D 1/34

[52] U.S. Cl. ..... 4/324; 4/397

[58] Field of Search ..... 4/52, 56, 57 P, 57 R, 4/67 R, 67 A

[56] References Cited

U.S. PATENT DOCUMENTS

| | | | |
|---|---|---|---|
| 1,013,225 | 1/1912 | Schulte | 4/67 R |
| 1,016,714 | 2/1912 | Schulte | 4/67 R |
| 1,729,546 | 9/1929 | Myers | 4/67 R |
| 2,440,389 | 4/1948 | Anderson | 4/57 R |
| 2,706,818 | 4/1955 | Graziosi | 4/57 R |
| 3,067,432 | 12/1962 | New | 4/67 A |
| 4,014,050 | 3/1977 | Goldsworthy | 4/67 A |

*Primary Examiner*—Charles E. Phillips

[57] ABSTRACT

A water flow control device and method for use in a toilet flushing apparatus, having a valve member and a flushing arm and handle assembly coupled to said valve member for lifting said valve member when said flushing arm and handle assembly is operated for controlling the flow of water between a toilet tank and a toilet bowl is described. The device comprises means attachable to the toilet flushing apparatus for restricting the distance the valve member is moved when the flushing arm and handle assembly is operated so that the valve member does not float upwardly and, when the flushing arm and handle assembly is returned to its initial position, the valve member immediately returns to its initial position for stopping water flow from the toilet tank into the toilet bowl.

9 Claims, 14 Drawing Figures

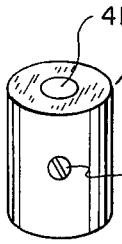
FIG. 7
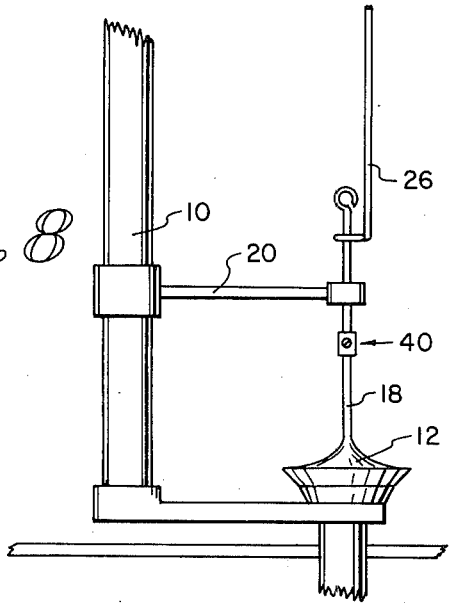
FIG. 8
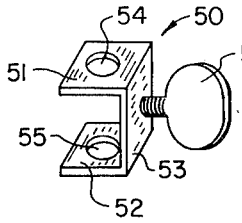
FIG. 9
FIG. 10
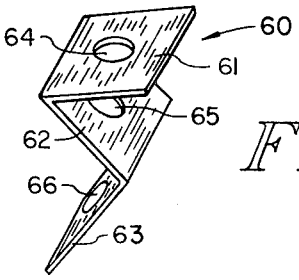
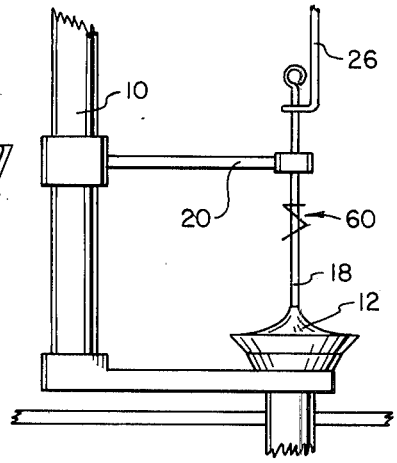
FIG. 11
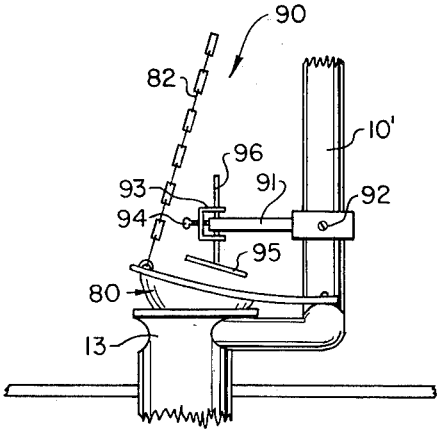
FIG. 14
FIG. 13
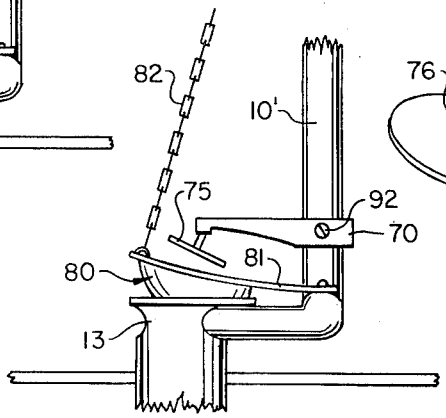
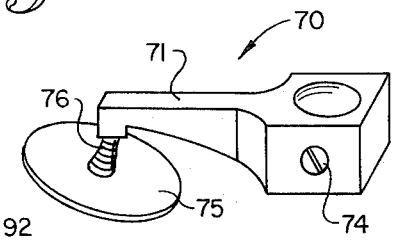
FIG 12

WATER-FLOW CONTROL DEVICE AND METHOD

BACKGROUND OF THE INVENTION

The present invention relates to water-flow control apparatus in general and in particular to a water-flow control device for use in a toilet flushing apparatus for controlling the flow of water between a toilet tank and a toilet bowl.

A typical toilet comprises a toilet tank and a toilet bowl. In the toilet tank there is provided flushing apparatus. When the flushing apparatus is operated, water stored in the tank flows from the tank into the toilet bowl for flushing the toilet bowl.

The flushing apparatus in the toilet tank is typically connected to a source of water. The flow of water from the water source into the tank is controlled by a valve assembly. The control of the valve assembly is provided by an air-tight ball or the like coupled to the valve assembly for turning off the flow of water when the water level in the tank reaches a predetermined level. For flushing the bowl after the desired amount of water is in the tank, there is provided in the tank and extending through a wall of the tank, a flushing arm and handle assembly. The flushing arm is connected to the handle assembly and to a valve member for releasing the water from the toilet tank to the toilet bowl. In one type of flushing apparatus, the flushing arm and handle assembly lifts the valve member by a system of lift wires, including an upper and a lower lift wire. The upper lift wire is called hereinafter a flushing wire so as to distinguish it from the lower lift wire which is simply called hereinafter the lift wire. The lower lift wire is attached to the valve member, as by threads and has an upper free end with a lift wire eyelet on the upper free end. A lift wire guide is provided for guiding the vertical travel of the lift wire when the flushing arm and handle assembly is operated for lifting the valve member. In this type of flushing apparatus the valve member typically comprises a ball type valve member. In other types of flushing apparatus, the valve member comprises a lid type or flapper type valve member. In the apparatus using a flapper type valve member, a lift wire guide is not required because the flapper valve is usually pivotably attached to the apparatus. Generally it is attached to the overflow pipe and lifted as by a chain connected to the flushing arm and handle assembly. Whatever the particular type, shape, style or construction of the valve member, it is generally somewhat buoyant such that, when the flushing arm and handle assembly is operated for lifting the valve member, the valve member, once lifted to a predetermined position, will tend to float until the water level in the tank is reduced to a predetermined minimum level, at which time the valve member will close the discharge outlet opening of the toilet tank and stop the flow of water therefrom into the toilet bowl.

Because the valve member controlling the flow of water from the discharge outlet tends to float when it is raised a predetermined amount, substantially all of the water in the toilet tank is discharged before the valve member closes the discharge outlet whenever the flushing arm and handle assembly is operated. For example, if a toilet tank contains 7 gallons of water, substantially all of the 7 gallons of water will be discharged into the toilet bowl even though the object or objects sought to be flushed from the toilet bowl do not require that much water to be flushed from the toilet bowl.

Due to severe water shortages in various parts of the country, it is presently important for the people in those parts to conserve water, and one of the methods employed for conserving water is to control the amount of water used for flushing toilets.

The amount of water used each time a toilet is flushed may be controlled in a number of ways. One of the ways the amount of water used may be controlled is by modifying the existing apparatus. If this is done by the manufacturer, it is, of course, time-consuming and expensive and would require adequate records to show the market areas in which the toilets are to be sold and to indicate which toilets sent to those areas must be modified. As a practical matter, this is nearly impossible to accomplish since, even in fairly localized market areas, certain portions of any given area are not necessarily suffering from a lack of water.

An alternative to a manufacturer modifying the toilet flushing apparatus to reduce the amount of water used for flushing a toilet, the purchaser or user of the toilet may perform the modification. While this may be considerably less expensive, it is still troublesome and would ordinarily require instructions from the manufacturer. Also, when the water shortage is passed, it would require, in any case, a reversal of the steps used for modifying the apparatus to return the apparatus to its original factory configuration.

A further consideration is that at times it may be desirable to be able to use a full tank of water for flushing.

For these reasons, whatever means or method is used for controlling water flow from a toilet tank into a toilet bowl, it is preferable if it is easy to implement and remove, reliable and inexpensive and, most importantly, meets the varied flushing needs and requirements of the persons using it. These needs and requirements will vary as a function of the liquid and solid character of the waste being flushed.

SUMMARY OF THE INVENTION

In view of the foregoing, a principal object of the present invention is a method and device for use in conjunction with a conventional toilet flushing apparatus, having a valve member in a toilet tank discharge outlet and a flushing arm and handle assembly coupled to said valve member for lifting said valve member when said flushing arm and handle assembly is operated, for controlling the flow of water between the toilet tank and a toilet bowl.

Another object of the present invention is a method and device which is attachable to a toilet flushing apparatus having a valve member in a toilet tank discharge outlet for restricting the distance the valve member in the apparatus is moved when a flushing arm and handle assembly in the apparatus is operated for moving the valve member.

Another object of the present invention is a method and device as above described which limits the upward floating movement of a valve member in a toilet flushing apparatus when a flushing arm and handle assembly connected to the valve member is operated for raising the valve member such that, when the flushing arm and handle assembly is returned to its initial position, the valve member immediately returns to its initial position for stopping the flow of water from the toilet tank into the toilet bowl.

Another object of the present invention is a water-flow control device for use in a toilet flushing apparatus as above described comprising a wire member having an L-shaped section, a j-shaped section and a straight section between said L-shaped and said j-shaped sections.

Another object of the present invention is a water-flow control device for use in a toilet flushing apparatus having a valve member, a lift wire connected to the wire member, said lift wire having an upper free end and a lift wire eyelet on said upper free end, a lift wire guide for guiding the vertical travel of said lift wire, and wherein the control device engages the lift wire eyelet and lift wire guide in operation for restricting the distance the valve member is lifted when the flushing arm and handle assembly is operated.

Another object of the present invention is a device for controlling water flow, comprising a tubular member with a set screw. The set screw is provided for removably securing the tubular member to the lift wire a predetermined distance below the lift wire guide as above described.

Another object of the present invention is a device comprising a U-shaped member with a thumb screw. Each leg of the U-shaped member is provided with a hole for receiving a lift wire as above described. The thumb screw is provided for securing the U-shaped member to the lift wire a predetermined distance below the lift wire guide as above described.

Still another object of the present invention is a device comprising a strip of resilient material which is folded in accordion fashion with each pleat of the device provided with a hole. The device is folded in such a fashion that the hole in each pleat can be aligned when the pleats are pressed together, as when the device is inserted on a lift wire as above described. When the pressure holding the pleats together is removed, and the pleats separate, the holes become misaligned and, by friction, secure the device to the lift wire at a predetermined position below the lift wire guide as above described.

Still another object of the present invention is a device attachable to an existing part of a flushing apparatus in a conventional toilet, such as, for example, the overflow pipe, for restricting the distance a flapper type valve may be lifted from a toilet tank discharge outlet.

A principal advantage of the water-flow control devices according to the present invention is that they may be inserted in the apparatus and used for controlling the flow of water between a toilet tank and a toilet bowl without modifying the factory-installed flushing apparatus. Also, the devices are adaptable to various types of flushing apparatus, are easily installed, reliable and relatively inexpensive.

DESCRIPTION OF THE DRAWINGS

The above and other objects, features and advantages of the present invention will become apparent from the following detailed description of the accompanying drawings in which:

FIG. 7 is a perspective view of another water-flow control device according to the present invention.

FIG. 8 is a view of the device of FIG. 7 installed in a conventional toilet tank flushing apparatus.

FIG. 9 is a perspective view of still another water-flow control device according to the present invention.

FIG. 10 is a perspective view of still another water-flow control device according to the present invention.

FIG. 11 is a view showing the installation of the device of FIG. 10 in a conventional toilet flushing apparatus.

FIG. 12 is a perspective view of still another water-flow control device according to the present invention.

FIG. 13 is a view showing the installation of the device of FIG. 12 in a conventional toilet flushing apparatus using a flapper-type valve.

FIG. 14 is a side elevation view of still another water-flow control device according to the present invention.

DETAILED DESCRIPTION

Figure 1:
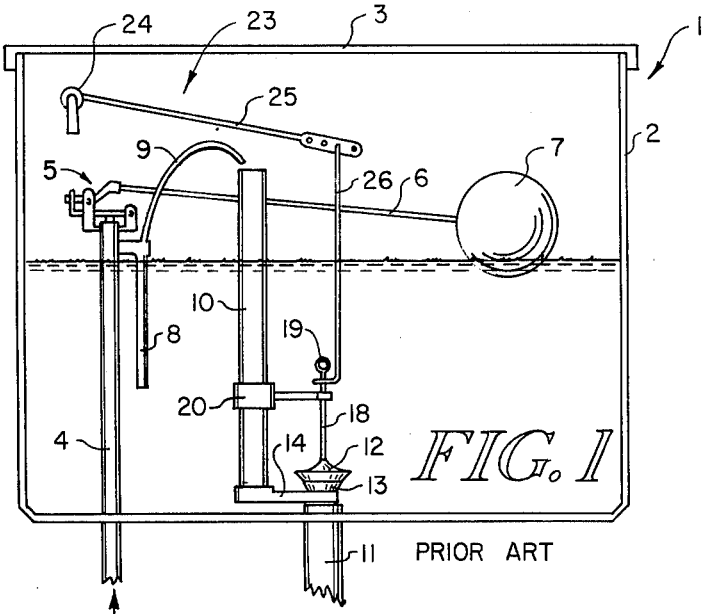
FIG. 1 PRIOR ART
FIG. 1 is an elevation view of a typical prior art toilet tank and toilet flushing apparatus.

Referring to FIG. 1, there is illustrated a toilet tank assembly 1 comprising a tank 2 and a cover 3. In the interior of the tank 2 and beneath the cover 3 there is provided a water-input pipe 4. The pipe 4 is connected to an external source of water (not shown). At the top of the pipe 4 there is provided a valve assembly 5. The valve assembly 5 is connected, by means of an elongated arm 6, to a hollow, airtight spherical member 7 or the like. To the right of the pipe 4 there is provided a downwardly extending, depending pipe 8. Extending from the top of the pipe 8 there is provided a curved pipe section 9. Pipe 9 has an output end for outputting water into the top of an open tubular standpipe member 10.

At the bottom of the tank 2 there is provided a discharge pipe 11 having a discharge outlet 13. The discharge pipe 11 is coupled, by means not shown, to a toilet bowl for discharging water from the interior of the tank 2 into the toilet bowl. The flow of water from the interior of the tank 2 to the toilet bowl through the pipe 11 is controlled by a valve member 12. At the top of the pipe 11, in the interior of the tank 2, the pipe 11 is fitted with the discharge outlet 13. As seen in FIG. 1, the valve member 12 is seated in the discharge outlet 13 for closing the water discharge pipe 11 and preventing the flow of water to the pipe 11 from the interior of the tank 2. The overflow pipe 10 is connected to the valve 12 by a pipe 14. The pipes 10 and 14 are used for discharging water into the toilet bowl through the pipe 11 only in the event that the water level in the tank 2 rises above the end of the pipe 10 and during filling of the tank 2 when water from the pipe 4 flows through the tube 9 into the overflow pipe 10. At all other times the flow of water from the tank 2 is controlled by the valve member 12.

Extending from the top of the valve member 12 there is provided a lift wire 18 having a free end on which is provided a lift wire eyelet 19. The lift wire 18 is slidably fitted in a lift wire guide member 20.

For raising the valve member 12 there is provided a flushing arm and handle assembly 23. In the flushing arm and handle assembly 23 there is provided a handle 24 and a flushing arm 25, which is connected to the lift wire 18 by a flushing wire 26. The flushing arm 25, as shown in FIG. 1, is typically fitted with a plurality of holes into one of which the flushing wire 26 is mounted.

In use, the operation of the handle 24 will cause the free end of the flushing arm 25 to be raised. Raising of the free end of the flushing arm 25 will lift the flushing wire 26. The lifting of the flushing wire 26 will cause the bottom of the wire 26 to engage the lift wire eyelet 19, raising the lift wire 18 and the valve member 12 attached thereto. When the valve member 12 is lifted, water begins to flow from the tank 2 through the discharge port 13, through the pipe 11 and into the toilet bowl (not shown). Ordinarily, the valve member 12 comprises means for trapping air within its interior or, if made of buoyant material, it causes the valve member 12, when lifted a predetermined distance, to float upwardly in the water in the tank 2. The valve member 12 will continue to float in the water in the tank 2 until the level of the water in the tank 2 is reduced to a predetermined amount. When the level of the water is reduced to a predetermined level, which is very near the level of the top of the discharge outlet 13, the valve member 12 will fall or otherwise settle into the discharge outlet 13 sealing the discharge outlet and preventing a further flow of water from the tank 2 therethrough. After the water level in the tank 2 has been reduced to the predetermined level, the downward travel of the lift wire 18 is guided, as previously described, by the guide member 20 to insure that the valve member 12 or 80 seats properly in the discharge outlet 13.

Immediately following the opening of the discharge outlet 13 by the raising of the valve member 12, the water level begins to be reduced in the tank 2, causing the spherical member 7 to fall downwardly. As the spherical member 7 falls, the valve assembly 5 is opened, allowing water from the external source to come into the tank 2 through the pipe 4 and pipe 8. At the same time, a measured amount of water is permitted to flow through the pipe 9, overflow pipe 10, pipe 14 and pipe 11 to bring the water level in the toilet bowl up to a predetermined level. Once begun, the water will flow into the tank 2 through the pipes 4 and 8 until the spherical member 7 is raised by the water level to such a height that it shuts off or otherwise closes the valve assembly 5.

While heretofore a full tank of water, as shown in FIG. 1, is ordinarily discharged each time the flushing arm and handle assembly 23 is operated, it has been found that a toilet can be made to flush even if the valve member 12 is restricted in its travel when the flushing arm and handle assembly is operated to open the water discharge outlet 13.

Figure 2:
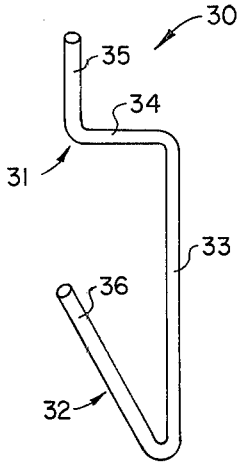
FIG. 2 is a water-flow control device according to the present invention.

Referring to FIG. 2, there is provided in accordance with the present invention a water-flow control clip 30. The clip 30 has an L-shaped section 31, a j-shaped section 32 and a straight section 33. The straight section 33 lies between the L-shaped section 31 and the j-shaped section 32. As seen in FIG. 2, the L-shaped section 31 has a straight leg portion 34 which extends perpendicularly from the straight section 33 and a straight leg portion 35 which extends perpendicularly from the opposite end of the leg portion 34.

Referring to the j-shaped section 32, there is provided in the j-shaped section 32, a straight leg portion 36. Preferably the leg section 36 of the j-shaped section 32 and the leg portions 34 and 35 of the L-shaped section 31 all lie in the same plane and extend in the same general direction relative to the straight section 33.

Figure 3:
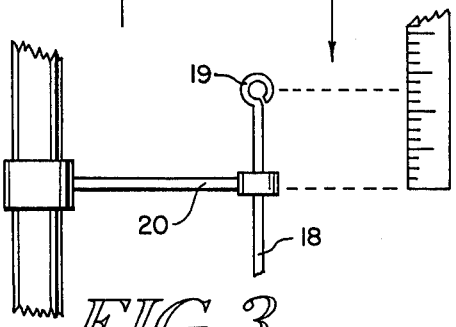
FIG. 3 illustrates a method of making a measurement for forming the device of FIG. 2.
Figure 4:
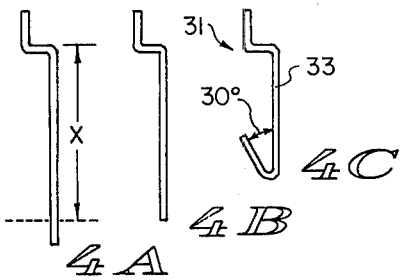
FIGS. 4*a*, 4*b* and 4*c* represent three stages in the forming of the device of FIG. 2.

Referring to FIGS. 3 and 4, the clip 30 is made from a length of relatively stiff wire material. Initially the L-shaped section 31 is formed with each of the leg portions 34 and 35 being approximately $\frac{3}{8}$ of an inch long.

To determine the length of the remainder of the clip 30 below the L-shaped section 31, the distance is measured between the center of the eyelet 19 and the lower end of the lift wire guide member 20 with the valve member 12 in a closed position, as shown in FIG. 3. To the measurement thus obtained there is added the distance of $2\frac{1}{2}$ inches. For example, if the distance between the center of the eyelet 19 and the lower end of the lift wire guide 20 is $1\frac{1}{2}$ inches, the total distance, $x$, as shown in FIG. 4*a*, is 4 inches. When the total distance, $x$, has been determined, tht portion of the wire exceeding $x$ is cut off, leaving, as shown in FIG. 4*b*, a wire member having the L-shaped section 31 and a straight section of a length $x$, as in our example, 4 inches long. After the excess wire has been cut away, as shown in FIG. 4*b*, the lower $1\frac{1}{2}$ inches of the wire is turned upward toward the straight section 33 at approximately a 30° angle in the same plane and in the same direction relative to the straight section 33 as the L-shaped section 31, as shown in FIG. 4*c*.

Figure 5:
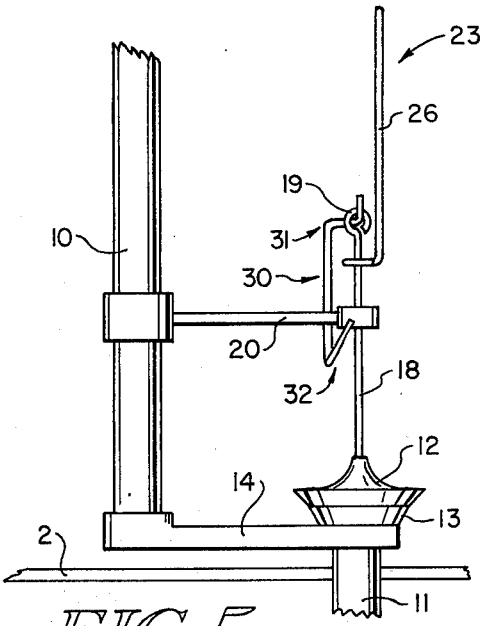
FIG. 5 is an elevation view of an apparatus with the device according to the present invention with the valve member of the apparatus in a closed position.

Referring to FIG. 5, to insert the clip 30 in the flushing apparatus, the straight leg portin 35 of the L-shaped section 31 is inserted in the lift wire eyelet 19 and the j-shaped section 32 is hooked beneath the lift wire guide member 20. The upper end of the leg portion 36 of the j-shaped section 32 should extend above the bottom edge of the guide member 20 so that it does not inadvertently slip from beneath the guide member. The j-shaped section may be bent at this time to accommodate this if necessary.

Figure 6:
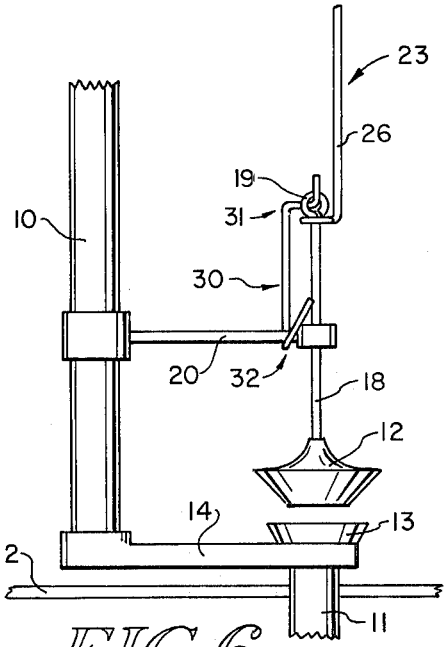
FIG. 6 is an illustration of the apparatus of FIG. 5 with the valve member in an open position and a device of the present invention engaging a lift wire guide.

Referring to FIG. 6, with the clip 30 inserted as described above with respect to FIG. 5, the distance the valve member 12 can be lifted when the flushing arm and handle assembly 23 is operated is restricted by the j-shaped section 32 of the clip 30 engaging the lift wire guide member 20.

In practice, the angle between the leg portion 36 of the j-shaped section 32 and the straight section 33 may be varied to accommodate various sizes and shapes of lift wire guide members 20 as they may appear in toilets of different manufacturers. Any adjustment or change in the length of the leg section 36 which affects the distance which the valve member 12 may be raised from the discharge outlet 13 when the flushing arm and handle assembly 23 is operated may be tolerated so long as the valve member 12 does not float upwardly in the water in the tank. The reason for this is that, so long as the valve member 12 does not float or begin to float upwardly, once it has been removed from the discharge outlet 13, it will immediately return to close off the discharge outlet 13 when the flushing arm and handle assembly 23 is returned to its initial position. Accordingly, the flow of water through the discharge outlet 13 will continue only so long as the flushing arm and handle assembly 23 is being physically held in a position which holds the valve member 12 in an open position.

Referring to FIGS. 7 and 8, there is provided in another embodiment of the present invention, for use in lieu of the clip 30, a device comprising a tubular member 40. In the member 40 there is provided an internal axial bore 41 and a set screw 42. The internal bore 41 has a diameter slightly larger than the diameter of the lift wire 18. The set screw 42 is provided for securing the tubular member 40 in position on the lift wire 18 a predetermined distance below the bottom surface of the lift wire guide member 20. As described above with respect to the clip 30, the position at which the tubular member 40 is secured to the lift wire 18 is such that the valve member 12 cannot be lifted above a height at which it begins to float in the water in the tank. In most conventional tanks this distance is approximately 1 inch.

To install the tubular member 40, the lift wire 18 is removed from the valve member 12 as by unscrewing or the like. After the lift wire member 18 is removed from the valve member 12, the tubular member 40 is slipped over the lift wire and secured thereto by the set screw 42. After the tubular member 40 is secured to the lift wire 18, the lift wire 18 is re-installed in the valve member 12. If necessary, after the tubular member 40 is installed, adjustments in its position relative to the guide member 20 can be made so as to insure immediate closure of the valve member 12 when the flushing arm and handle assembly 23 is returned to its initial position.

Referring to FIG. 9, there is provided another embodiment of the present invention comprising a U-shaped stop member 50. The stop member 50 is similar in operation, installation and function to the tubular member 40. It comprises a U-shaped, relatively stiff member having a pair of spaced leg members 51 and 52 which extend in parallel and perpendicularly from the ends of a center part 53. The leg members 51 and 52 are provided with a hole 54 and 55, respectively, which are coaxial. Centrally located in the center of the center part 53 there is provided a thumb screw 56.

To install the stop 50 on the lift wire 18, the valve member 12 is removed from the lift wire 18 and the stop 50 inserted thereon in the same manner as described above with respect to the installation of the tubular member 40. After the stop 50 is inserted on the lift wire 18, the position of the stop is secured at the desired location by means of the thumb screw 56, as described above with respect to the positioning of the member 40.

Referring to FIGS. 10 and 11, there is provided still another embodiment of the present invention comprising a stop member 60. In the stop member 60 there is provided a plurality of pleats 61, 62 and 63. Each of the pleats 61, 62 and 63 has a centrally located hole 64, 65 and 66, respectively. The holes 64, 65 and 66 can be made substantially coaxial when the pleats 61, 62 and 63 are squeezed together, as will be described. The pleats 61, 62 and 63 are formed from a strip of resilient material as by folding the strip along a line intermediate adjacent ones of the holes 64, 65 and 66.

To install the stop member 60, the valve member 12 is removed from the lift wire 18, as described above. After the valve member is removed from the lift wire 18, the member 60 is squeezed so as to align the holes 65, 65 and 66. After the holes 64, 65 and 66 are aligned, the member 60 is slipped over the lift wire 18 and raised to a predetermined distance — for example, 1 inch — below the lower edge of the guide member 20 when the valve member 12 is in a closed position. When the stop member 60 is positioned within an inch or the like of the guide member, as described, the stop member 60 is allowed to expand. When the member 60 expands, the holes 64, 65 and 66 move out of registration and, by means of friction, hold the member 60 in place and secure in position on the lift wire 18 such that, when the lift wire is lifted, the distance it travels is restricted by the stop member 60.

Referring to FIG. 12, there is provided, for use in a toilet flushing apparatus utilizing a flapper-type valve member in place of the ball-type valve member 12 of FIGS. 1–13, an alternative embodiment of the present invention comprising a support and stop assembly 70. The assembly 70 is provided with a cantilever arm 71. At one end of the arm 71 there is provided a bore 73 for receiving the overflow pipe 10 and a set screw 74 for securing the arm 71 to the overflow pipe 10. The specific manner of mounting the assembly 70 to the overflow pipe 10 is conventional and may be done in the manner used for mounting the conventional lift wire guide member 20. At the free end of the arm 71 there is provided a disk member 75. The disk member 75 is fitted to the free end of the arm 71 as by a screw fastener 76. Preferably the disk member 75 is fitted to the arm 71 by the screw fastener 76 at an angle which corresponds to the angle to which the flapper-type valve member hereafter described is lifted.

Referring to FIG. 13, there is shown a flapper-type valve member 80 having a connecting arm 81. The connecting arm 81 of the valve member 80 is connected to an overflow pipe 10'. Overflow pipe 10' is identical to the overflow pipe 10 of FIGS. 1–11 except that means are provided for attaching the flapper-type valve 80 in position to the pipe. At the end of the flapper-type valve 80, opposite from the point of connection to the overflow pipe 10', the flapper-type valve 80 is connected to a chain 82. The chain 82 is also connected to a conventional flushing arm and handle assembly (not shown) such as the flushing arm and handle assembly 23 of FIG. 1.

In use, when the flapper-type valve member 80 is lifted by the chain 82 by a predetermined amount, it will contact the disk member 75. This prevents further lifting of the valve member. The restricting of the lifting of the valve member serves to prevent the valve member from floating, as described above with respect to the valve member 12 of FIGS. 1–11.

Referring to FIG. 14, there is provided another embodiment of the present invention for use with a flapper-type valve member 80, as described above, comprising a stop member assembly 90. In the stop member assembly 90 there is provided a supporting arm 91. At one end of the arm 91 there is provided a bore for slidably fitting the arm 91 over the overflow pipe 10' and a screw 92 for securing the arm 91 on the overflow pipe 10' at a predetermined position relative to the flapper valve 80. Fitted to the opposite end of the arm 91 there is provided a U-shaped bracket 93. Centrally located in the bracket 93, there is provided a thumb screw 94 for engaging the end of the arm 91. To engage the flapper-valve 80, there is provided a disk member 95. The disk member 95 is provided with a shaft 96 extending upwardly therefrom through a hole provided in the arm 91 and in each of the legs of the bracket 93. Preferably, the disk 95 is positioned at an angle relative to the shaft 96. This angle corresponds to the angle between the upper surface of the flapper-type valve 80 and the plane of the outlet of the discharge outlet 13 which is formed when the flapper-type valve 80 is lifted to the maximum height consistent with the valve not floating and with the valve closing immediately when the flushing arm and handle assembly is returned to its initial position.

The position of the disk 95 may be adjusted with the thumb screw 94. For example, by loosening and tightening the thumb screw 94 against the end of the arm 91, the shaft 96 extending from the disk 95 can be moved upwardly and downwardly for repositioning the disk 95 relative to the upper surface of the flapper valve 80.

The embodiment of FIG. 14 is particularly useful in those toilet installations which have been converted from a ball-type valve to a flapper-type valve if there remains — though possibly unused — the lift wire guide member described with respect to FIGS. 1–11. In those installations, if the diameter of the shaft 96 corresponds to the diameter of the lift wire 18, previously used with the guide member, the guide member can be used for supporting the disk 95, thereby eliminating the need for and expense of providing a special disk support member such as the member 70 of FIGS. 12 and 13.

Several embodiments of a water-flow control device according to the present invention are described for use in two commonly known and used types of toilet flushing apparatus. It is contemplated, however, that various changes and modifications, both in the structure and in the materials used, can be made and that devices according to the present invention may be used in other types of flushing apparatus without departing from the spirit and scope thereof. Accordingly it is intended that the present invention be not limited to the embodiments described herein but rather be determined by reference to the claims hereinafter provided and their equivalents.

What is claimed is:

1. A water-flow control device for use in a toilet flushing apparatus having a valve member and a flushing arm and handle assembly coupled to said valve member for lifting said valve member when said flushing arm and handle assembly is operated, for controlling the flow of water between a toilet tank and a toilet bowl, comprising means attachable to said toilet flushing apparatus for restricting the distance said valve member is moved when said flushing arm and handle assembly is operated so that said valve member does not float upwardly and, when said flushing arm and handle assembly is returned to its initial position, said valve member immediately returns to its initial position for stopping water flow from the toilet tank into the toilet bowl and wherein said restricting means comprises a member having an L-shaped section, a j-shaped section and a straight section between said L-shaped section and said j-shaped sections, and wherein said L-shaped and said j-shaped sections are in the same plane.

2. A water-flow control device according to claim 1 wherein said L-shaped section has a portion which extends perpendicularly from said straight section and said j-shaped section has a portion which extends at an angle relative to said straight section in the same general direction from said straight section as said perpendicular portion of said L-shaped section.

3. A water-flow control device for use in a toilet flushing apparatus having a lift wire connected to a valve member, said valve member being provided for controlling water flow between a toilet tank and bowl, said lift wire having an upper free end; a lift wire eyelet on said upper end; a lift wire guide for guiding the vertical travel of said lift wire; and a flushing arm and handle assembly coupled to said lift wire for lifting said valve member when said flushing arm and handle assembly is operated, comprising means attachable to said toilet flushing apparatus for restricting the distance said valve member is moved when said flushing arm and handle assembly is operated so that said valve member does not float upwardly, and when said flushing arm and handle assembly is returned to its initial position, said valve member immediately returns to its initial position for stopping water flow from the toilet tank into the toilet bowl and wherein said restricting means comprises:

an elongated member;

means located at one end of said elongated member for engaging said lift wire eyelet; and means provided at the opposite end of said elongated member for engaging said lift wire guide.

4. A water-flow control device according to claim 3 wherein said elongated member is an elongated wire member, said means for engaging said lift wire eyelet is an L-shaped section of said elongated wire member and said means for engaging said lift wire guide is a section of said elongated wire member which is shapable in the general form of a "*j*" prior to use.

5. A water-flow control device according to claim 4 wherein said elongated wire comprises a straight section between said L-shaped section and said section of said elongated wire which is shapable in the general form of a "*j*" prior to use, said straight section having a length proportional to the distance between said lift wire eyelet and the lower edge of said lift wire guide, and wherein said L-shaped section has a first portion extending perpendicularly from one end of said straight section and a second portion extending perpendicularly from the opposite end of said first portion.

6. A water-flow control device according to claim 5 wherein said L-shaped section and said section which is shapable in the general form of a "*j*" prior to use lie in the same plane after said *j*-shaped section is formed.

7. A water-flow control device for use in a toilet flushing apparatus using a valve member which is coupled to a lift wire having an upper free end with a lift wire eyelet formed therein, a lift wire guide for guiding the vertical travel of said lift wire and a flushing arm and handle assembly coupled thereto for lifting the valve member when the flushing arm and handle assembly is operated comprising:

a wire member having an L-shaped section for engaging said lift wire eyelet;

a *j*-shaped section for engaging said lift wire guide; and a straight section between said L-shaped and said *j*-shaped sections which has a length which is proportional to the distance between said lift wire eyelet and the lower edge of said lift wire guide as measured when said valve member is in a closed position.

8. A water-flow control device according to claim 7 wherein the free end portion of said *j*-shaped section has a predetermined length and is bent upwardly relative to the remainder of said *j*-shaped section at a predetermined angle.

9. A water-flow control device according to claim 8 wherein said predetermined length is approximately 1.5 inches and said predetermined angle is approximately 30°.

* * * * *